US005988390A

United States Patent [19]

McCoy

[11] Patent Number: 5,988,390

[45] Date of Patent: Nov. 23, 1999

[54] TRAILER SHIPPING CONTAINER

[75] Inventor: Richard McCoy, Granger, Ind.

[73] Assignee: Reese Products, Inc., Elkhart, Ind.

[21] Appl. No.: 09/105,869

[22] Filed: Jun. 26, 1998

Related U.S. Application Data

[60] Provisional application No. 60/050,874, Jun. 26, 1997.

[51] Int. Cl.[6] ..... B65D 19/00

[52] U.S. Cl. ..... 206/596; 206/523; 206/586

[58] Field of Search ..... 206/386, 596, 206/598, 600, 523, 586, 557, 593; 108/51.3; 229/122.21, 925

[56] References Cited

U.S. PATENT DOCUMENTS

| | | | |
|---|---|---|---|
| 2,597,845 | 5/1952 | Reeser | 229/122.21 |
| 3,199,764 | 8/1965 | Oliver et al. | 206/600 |
| 3,442,434 | 5/1969 | Simas | 206/386 |
| 3,529,717 | 9/1970 | McDougal | 206/598 |
| 3,606,969 | 9/1971 | Voytko | 206/386 |
| 3,730,417 | 5/1973 | Lawson | 206/598 |
| 4,085,847 | 4/1978 | Jacalone | 206/600 |
| 5,127,527 | 7/1992 | Graham et al. | 206/600 |
| 5,395,191 | 3/1995 | Keenan et al. | 206/593 |
| 5,595,304 | 1/1997 | Timmins | 206/598 |

*Primary Examiner*—Paul T. Sewell
*Assistant Examiner*—Nhan T. Lam
*Attorney, Agent, or Firm*—Leon E. Redman; Lloyd D. Doigan

[57] ABSTRACT

A trailer shipping container having an exterior box for surrounding a portion of a trailer body with an upper portion of the trailer body extending upwardly out of the open end of the exterior box. Foam billets contoured to fit the shape of the lower corners of the trailer body are positioned in the bottom of the exterior box to support the trailer body and to support an interior box containing other trailer assembly components. The interior box is spaced above the floor of the exterior box and a pair of fork lift slots are provided near the bottom of the exterior box to permit the forks of a fork lift truck to contact the undersurface of the interior box to lift and maneuver the entire container. Corner slots at the upper end of the exterior box form inwardly projecting tabs to provide support and vertical alignment for the trailer body. The corner slots also locate and receive a cinch strap to tightly band the container to the trailer body. A plastic protective bag encompasses the trailer body extending upwardly out of the open top of the exterior box.

3 Claims, 3 Drawing Sheets

TRAILER SHIPPING CONTAINER

This is a continuation of Provisional Application Ser. No. 60/050,874 filed Jun. 26, 1997.

FIELD OF THE INVENTION

This invention relates to shipping containers and more particularly to shipping containers for trailers that are shipped disassembled as trailer body and various other assembly components.

SUMMARY OF THE INVENTION

It is an object of the invention to provide a cost effective, convenient to use, light weight yet strong trailer shipping container that will protect a trailer kit including a trailer body and various other component parts needed to assemble the trailer kit at its destination.

It is a further object of the invention to provide such a trailer shipping container that is readily portable and disposable.

It is another object of the invention to eliminate the need for wooden skids to move packaged trailer kits with a fork lift truck.

These and various other objects and advantages are achieved by the trailer shipping container of the present invention which includes an exterior box with upstanding side walls provided with lower spaced apart apertures for receiving the fork of a fork lift and corner tabs that extend inwardly to brace a trailer body that is supported at the lower end of the box by opposed foam billets formed to correspond to the configuration of the shape of the trailer body. A strap surrounding the box and received in the corner recesses formed by the inwardly extending corner tabs to cinch the box against the trailer body. An interior box which may contain various trailer assembly components is supported above the floor of the exterior box by the opposed foam billets so that the bottom of the interior box provides a firm support surface for the forks of a fork lift truck inserted through the lower spaced apart apertures to move a trailer assembly kit secured in the shipping container.

DESCRIPTION OF THE PREFERRED EMBODIMENT

Figure 1:
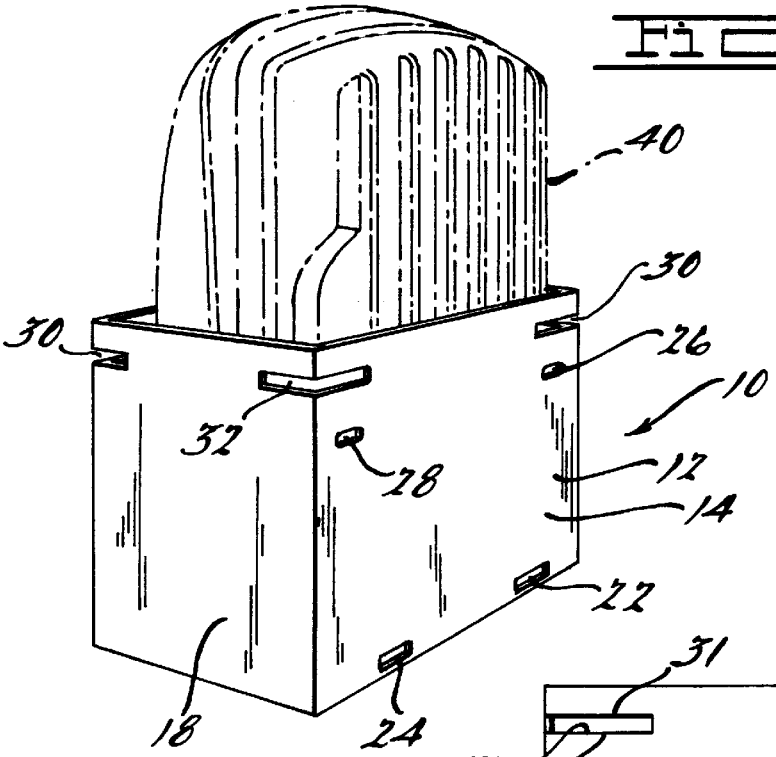
FIG. 1 is a perspective view of a the exterior box of the trailer shipping container of the present invention.
Figure 2:
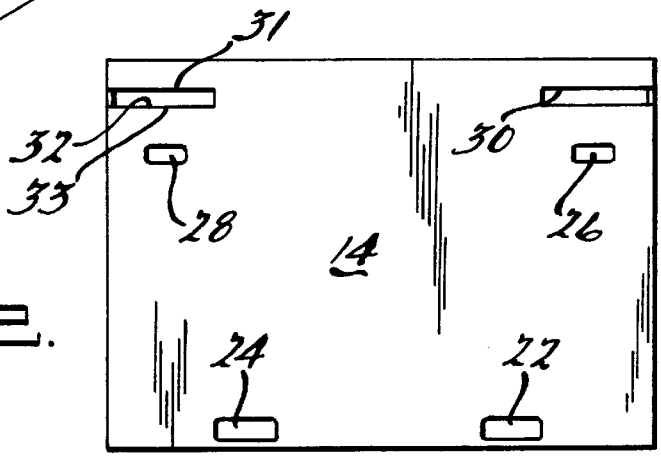
FIG. 2 is a front elevational view of the trailer shipping container of FIG. 1.
Figure 3:
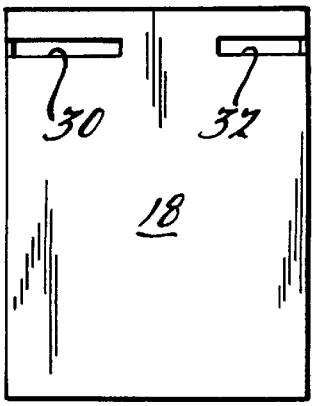
FIG. 3 is a left side elevational view thereof.
Figure 4:
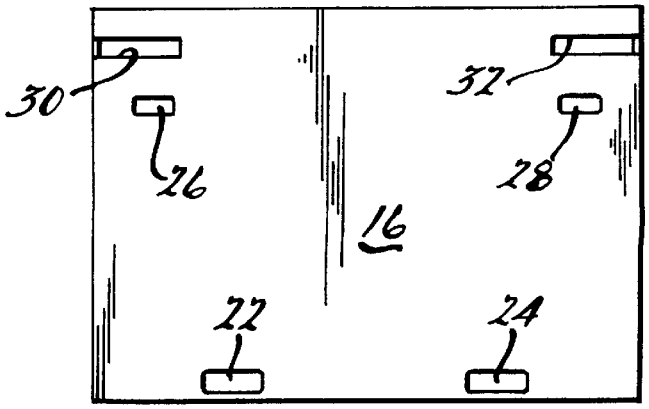
FIG. 4 is a rear elevational view thereof.
Figure 5:
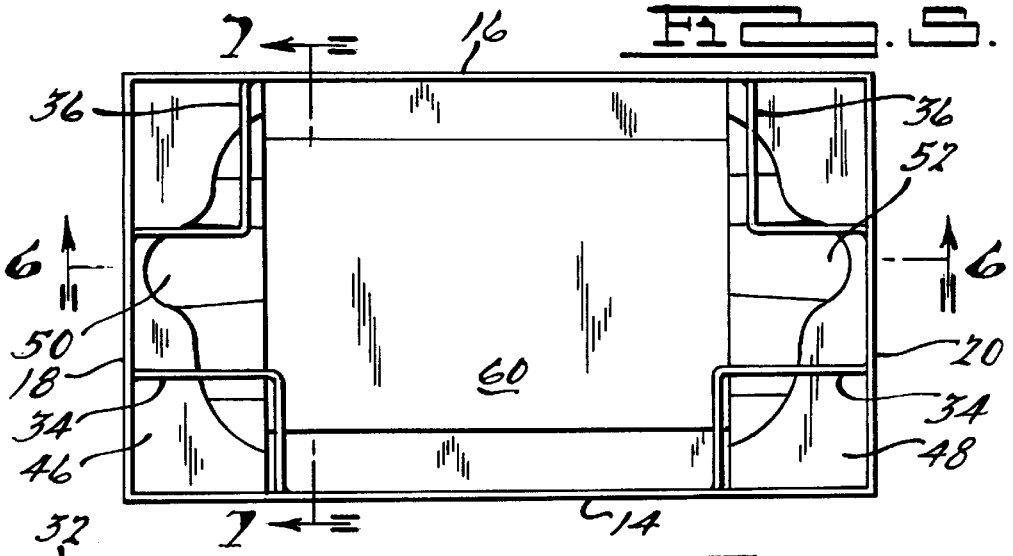
FIG. 5 is an enlarged top plan view of the trailer shipping container of FIG. 1 with an interior box supported within foam billets.
Figure 6:
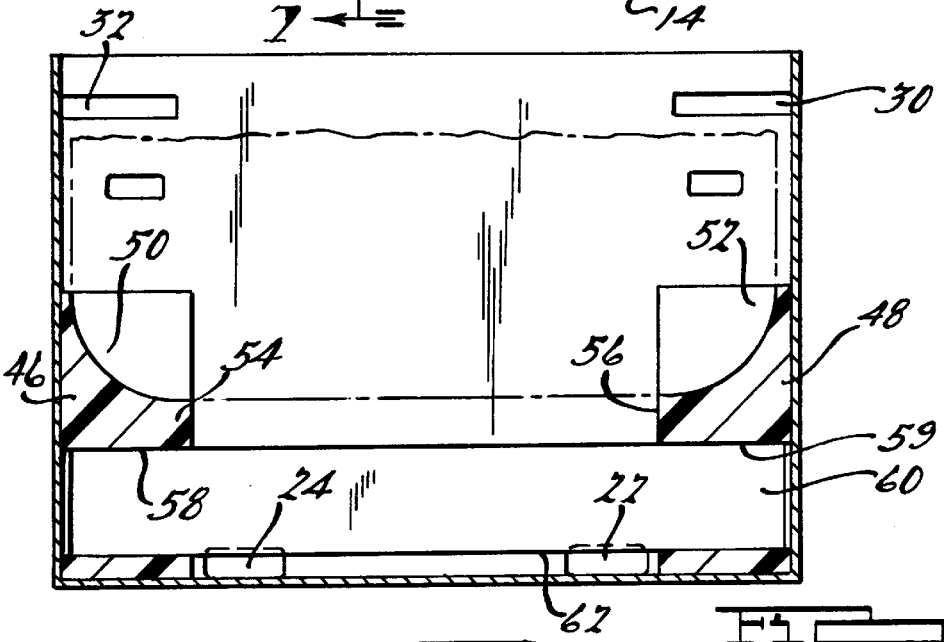
FIG. 6 is a cross-sectional view taken along line 6—6 of FIG. 5 showing the interior box supported above the floor of the exterior box by the foam billets.
Figure 7:
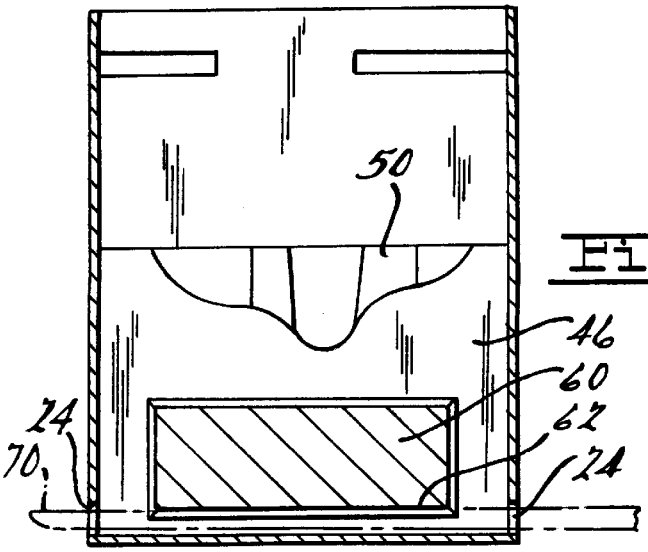
FIG. 7 is a cross-sectional view taken along line 7—7 of FIG. 5.
Figure 8:
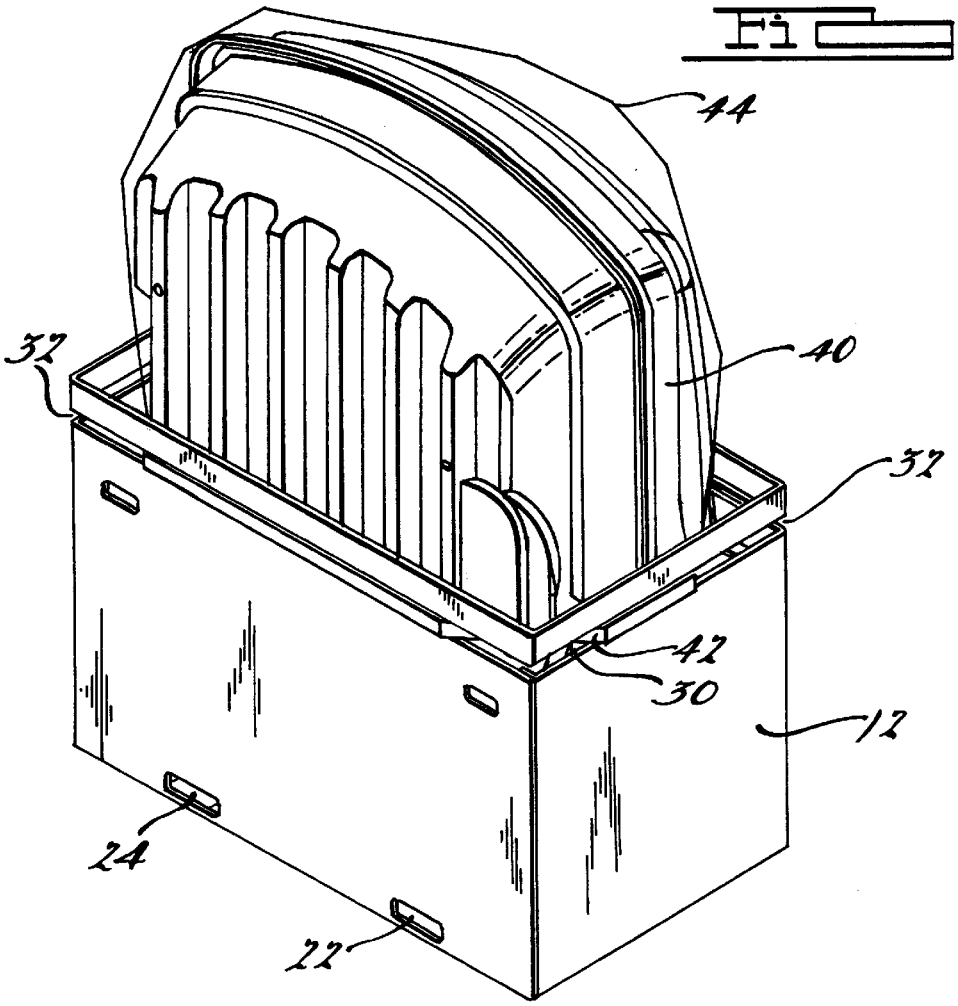
FIG. 8 is a perspective view of the trailer shipping container with a trailer body inside the container with a protective bag over the upwardly extending trailer end along with a strap banding the trailer shipping container to the trailer body.
Figure 9:
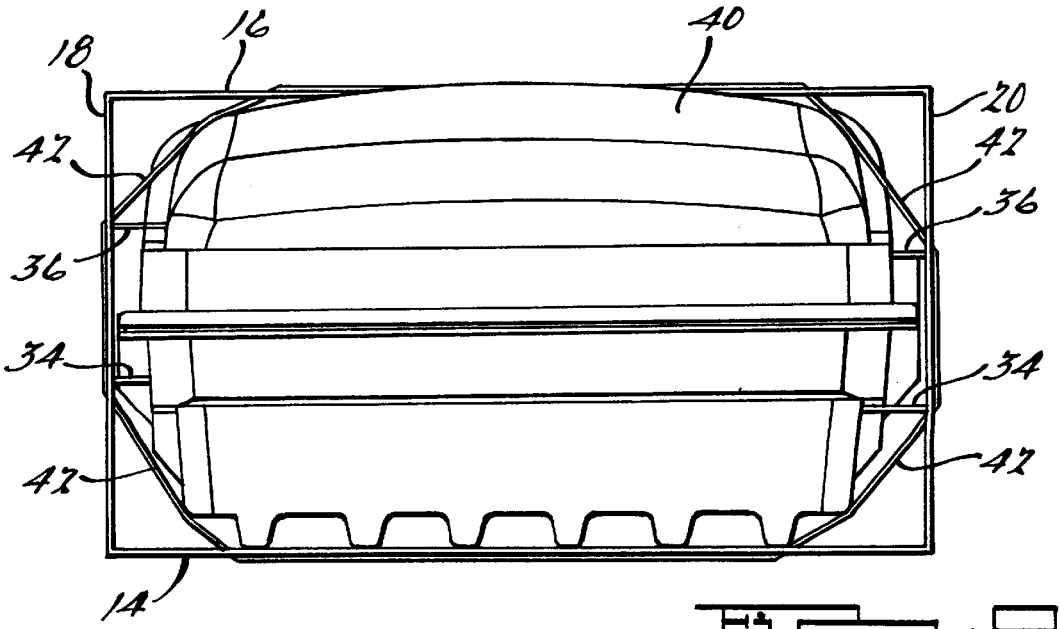
FIG. 9 is a top plan view of the trailer body and trailer shipping container of FIG. 8.

Referring to FIGS. 1–9, a shipping container generally designated 10 includes a corrugated cardboard exterior box

12 formed in a rectangular configuration with upstanding side walls 14, 16, 18 and 20. Each of the front and back sides 14 and 16 are provided with slots 22 and 24 near the bottom of box 12. The slots 22 and 24 are spaced apart, aligned and configured to receive the forks (see FIG. 7) of a conventional fork lift truck (not shown). Hand grasp slots 26 and 28 are provided on each of the front and back sides 14 and 16 to facilitate manual manipulation of the shipping container 10. Corner slots 30 and 32 are formed near the top of the box 10 by horizontal parallel slits 31, 33 at each of the four corners of box 10. The portion of the cardboard between the slits is pushed inward to form inwardly projecting tabs 34 and 36 (see FIG. 5) engage the corners of trailer body 40 to assist in the vertical alignment and support of the trailer body 40 extending upwardly through the open top of box 12. The corner slots 30, 32 also provide recesses that receive and locate a cinch strap 42 (see FIGS. 7 and 8) that is firmly tightened about the girth of the box 12 to secure the container 10 to the trailer body 40 whose upper exposed end may be covered with a protective plastic sack 44 (see FIG. 8).

Two foam billets 46, 48 (see FIGS. 5-7) are provided for insertion into the bottom of the box 12 along the opposed left and right sides 18, 20, respectively. The foam billets 46 and 48 are configured to conform to the inside lower sides 18, 20 and bottom corners of box 12 to strengthen and add rigidity to the exterior cardboard box 12 and to support and cushion the trailer body 40 within contoured recesses 50, 52 disposed into the inner upper edge of the foam billets 46, 48, respectively. Each of the contoured recesses 50 and 52 is configured to conform to the unique configuration and shape of each of the end corners of the trailer body 40 to be supported thereon. The inside wall 54, 56, respectively, of each of the foam billets 46, 48 has a rectangular pocket 58, 59 formed therein to receive the ends of an elongated rectangular interior trailer assembly component box 60. The pockets 58 and 59 face each other and are positioned in the foam billets 46 and 48 to support the interior trailer component box 60 above the floor of the exterior box 12 at a height where the bottom or undersurface 62 of the interior box 60 is generally aligned with the upper edge of the fork lift slots 22 and 24 so that the undersurface of the interior box 60 provides a bearing surface for the forks 70 of a fork lift truck inserted through the fork lift slots 22 and 24 for moving the trailer container 10 via the fork lift truck. Thus, the foam billets 46, 48 in addition to supporting and cushioning the trailer body 40 and providing strength and rigidity to the exterior box 10, provide a means in cooperation with the fork lift slots 22 and 24 to interlock the interior assembly component box 60, whose bottom surface 62 provides a firm fork lift bearing surface, with the exterior box 12 so that the entire trailer container 10 containing the trailer body 40 and interior assembly component box 60 can be lifted by the fork lift truck as an integrated unit. Furthermore, the weight of the trailer body 40 and assembly component box 60 is concentrated near the bottom of the container 10 providing an advantageously low center of gravity. This reduces any risk of tipping during shipment or handling.

In use the tow foam billets 52, 54 are mounted onto the opposite ends of the interior component container 60 and this subassembly is lowered into the bottom of the surrounding exterior box 12. The trailer body 40 is then lowered into the exterior box 12, coming to rest on the upper inner contoured recesses 50, 52 of the foam billets 46, 48 which recesses 50, 52 are configured to conform to the configuration of the trailer body 40 to support and protect the trailer body 40 during shipping. The upper end of the trailer body

40 may then be covered with the protective plastic sack 44. Alternatively, the protective bag 44 may be placed about the lower end of the trailer body 40 and its open end tied at the top of the bag 44. The cinch strap 42 is then positioned about the girth of the exterior box 12 and located within the four corner slots 30, 32, 34 and 36. The cinch strap is then tightened to secure the shipping container 10 so that the trailer body 40 and assembly components int he interior component box 60 are ready for shipment. After the trailer body 40 and the interior box 60 are removed from the container 10, the light weight container 10 can be easily moved by hand to a disposed area and crushed into a small compact mass for easy disposal.

Thus, the trailer shipping container 10 of the present invention provides a convenient, cost effective package for a single trailer unit that is very light weight, yet very strong and protective without the need for wood reinforcement or the use of a wood skid for handling with a fork lift truck while being readily disposable.

The foregoing is a description of the preferred embodiment of the invention which may be modified without departing from the spirit and scope of the following claims and their equivalents.

I claim:

1. A shipping container to be lifted and handled by a fork lift truck having horizontally extending forks, said shipping container comprising:

an exterior box having a floor and upstanding side walls;

an interior box having an undersurface;

two spaced apart foam billets disposed at the floor of said exterior box, said foam billets supporting said interior box above said exterior box floor to provide space between the undersurface of said interior box and said exterior box floor;

a pair of spaced apart apertures provided in at least one of said upstanding sides of said exterior box, said apertures positioned to provide access for said forks of said fork lift truck to extend within the space between said interior box and said floor and to contact the undersurface of said interior box for lifting and handling said shipping container with said fork lift truck;

at least one corner slot provided at a corner of said upstanding side walls of said exterior box;

a cinch strap located by said at least one corner slot and encompassing said container; and at least one inwardly projecting tab formed adjacent said at least one corner.

2. A shipping container to be lifted and handled by a fork lift truck having spaced apart horizontally extending forks, said shipping container comprising:

an exterior corrugated cardboard box having a floor and four upstanding side walls and an open top;

an interior box having an undersurface;

two spaced apart foam billets disposed at the floor of said exterior box to support said interior box above said exterior box floor providing a space between the undersurface of said interior box and said exterior box floor;

a pair of spaced apart fork lift slots provided in each of two of said opposing side walls, said fork lift slots of one of said side walls aligned with the fork lift slots of the other of said opposing side walls, said aligned fork lift slots providing access for the forks of said fork lift truck to extend inwardly through the fork lift slots of one of said opposing side walls through the space between the undersurface of said interior box and said exterior box floor and for the forks to extend said exterior box floor and for the forks to extend outwardly through the fork lift slots of the other of said opposing side walls to enable the forks of said fork lift truck to contact the undersurface of said interior box for lifting and handling said shipping container;

an inwardly projecting corner tab formed in each corner of said upstanding side walls of said exterior box;

said inwardly projecting corner tabs disposed in a common horizontal plane and providing a corner slot at each corner of the exterior box; and a band located to pass through said corner slots and encompass said container.

3. The shipping container of claim 2 further comprising a protective bag disposed at said open top of said exterior box.

* * * * *